US009039254B2

(12) United States Patent
Danesh

(10) Patent No.: US 9,039,254 B2
(45) Date of Patent: May 26, 2015

(54) WIDE ANGLE ADJUSTABLE RETROFIT LAMP FOR RECESSED LIGHTING

(71) Applicant: Michael D. Danesh, Beverly Hills, CA (US)

(72) Inventor: Michael D. Danesh, Beverly Hills, CA (US)

( * ) Notice: Subject to any disclaimer, the term of this patent is extended or adjusted under 35 U.S.C. 154(b) by 62 days.

(21) Appl. No.: 13/791,087

(22) Filed: Mar. 8, 2013

(65) Prior Publication Data

US 2014/0254177 A1 Sep. 11, 2014

(51) Int. Cl.

| | |
|---|---|
| ***F21V 21/30*** | (2006.01) |
| ***F21V 29/00*** | (2006.01) |
| ***F21S 8/02*** | (2006.01) |
| ***F21V 23/00*** | (2006.01) |
| *F21V 17/16* | (2006.01) |
| *F21Y 101/02* | (2006.01) |

(52) U.S. Cl.

CPC ..... *F21V 21/30* (2013.01); *F21V 29/2212* (2013.01); *F21S 8/026* (2013.01); *F21V 17/164* (2013.01); *F21V 23/009* (2013.01); *F21Y 2101/02* (2013.01)

(58) Field of Classification Search

CPC ..... F21K 9/00; F21K 9/26; F21S 8/02; F21S 8/022; F21V 15/01; F21V 21/00; F21V 21/04; F21V 21/14; F21V 21/26; F21V 21/30; F21V 21/225; F21V 29/225; F21V 29/262

USPC ..... 362/145–148, 153, 153.1, 249.01, 362/249.02, 249.03, 249.07, 249, 269, 285, 362/427, 428, 545, 546, 548, 249.1, 362/362–366

See application file for complete search history.

(56) References Cited

U.S. PATENT DOCUMENTS

| | | | | |
|---|---|---|---|---|
| 6,350,043 | B1 * | 2/2002 | Gloisten | 362/287 |
| 6,719,438 | B2 * | 4/2004 | Sevack et al. | 362/147 |
| 7,431,482 | B1 * | 10/2008 | Morgan et al. | 362/364 |
| 7,651,245 | B2 * | 1/2010 | Thomas et al. | 362/294 |
| 7,677,766 | B2 * | 3/2010 | Boyer | 362/294 |
| 7,972,035 | B2 * | 7/2011 | Boyer | 362/289 |
| 8,152,334 | B2 * | 4/2012 | Krogman | 362/249.02 |
| 8,182,116 | B2 * | 5/2012 | Zhang et al. | 362/294 |
| 8,403,533 | B1 * | 3/2013 | Paulsel | 362/249.02 |
| 2009/0237924 | A1 | 9/2009 | Ladewig | |
| 2010/0061108 | A1 | 3/2010 | Zhang et al. | |
| 2010/0110698 | A1 * | 5/2010 | Harwood et al. | 362/365 |
| 2010/0148673 | A1 * | 6/2010 | Stewart et al. | 315/121 |
| 2010/0246172 | A1 * | 9/2010 | Liu | 362/235 |
| 2012/0113642 | A1 * | 5/2012 | Catalano | 362/249.02 |

FOREIGN PATENT DOCUMENTS

| | | |
|---|---|---|
| EP | 2453169 | 5/2012 |
| EP | 2193309 | 7/2012 |

* cited by examiner

*Primary Examiner* — Hargobind S Sawhney

(57) ABSTRACT

A recessed lighting system is provided. The recessed lighting system includes a light module and a driver separately coupled to a chassis. The light module includes one or more rotatable prongs for allowing the light module to pivot while the driver and chassis remain static. By being mechanically separate, the driver does not interfere with the movement of the light module. In particular, since the light module is not directly coupled to and is mechanically separate from the driver, pivoting the light module does not require space in a cavity of an associated housing to accommodate the rotation of the driver. This independent freedom of movement allows the light module to achieve a greater degree of rotation in comparison to light modules that are mechanically dependent on drivers.

19 Claims, 7 Drawing Sheets

WIDE ANGLE ADJUSTABLE RETROFIT LAMP FOR RECESSED LIGHTING

FIELD

An embodiment relates to a pivoting retrofit recessed lighting fixture system that has a universal pivoting light module and a detached/separate driver, which allows for a greater degree of movement of the light module without being encumbered by walls of an associated recessed lighting fixture housing. Other embodiments are also described.

BACKGROUND

Recessed lighting systems are typically installed or mounted into an opening in a ceiling or a wall. Recessed lighting systems generally consist of a trim, a light module, a driver, and a housing. In a diode based lighting system, the driver is directly coupled to and modulates power for the light module. The combined light module and driver are placed into the housing such that light appears to shine from a hole in the ceiling. The trim acts as a cover to hide the edge around the hole in the ceiling while allowing light to penetrate through an aperture.

Although many recessed lighting systems maintain the light module in a fixed downward position aligned with the center longitudinal axis of the housing, recessed lighting systems have been introduced that allow the combined light module and driver to pivot such that light is directed at an angle relative to the longitudinal axis. In this configuration, the light module and the driver are mechanically unified or rigidly fixed to each other such that movement of the light module also moves the driver. As housings for these pivoting lighting systems shrink in size, the degree of movement of the combined light module and driver similarly decreases. In particular, as the dimensions for housings decrease in the transverse direction (i.e., the "can" diameter becomes smaller), the room for movement of the combined light module and driver is reduced. This lack of freedom of movement is often seen in retrofitted recessed lighting systems in which a newer driver and light module are placed into an existing housing. Since the housing is not intended for this particular combination of light module and driver, pivoting of the combined light module and driver becomes highly constrained.

BRIEF DESCRIPTION OF THE DRAWINGS

The embodiments of the invention are illustrated by way of example and not by way of limitation in the figures of the accompanying drawings in which like references indicate similar elements. It should be noted that references to "an" or "one" embodiment of the invention in this disclosure are not necessarily to the same embodiment, and they mean at least one.

DETAILED DESCRIPTION

Several embodiments are described with reference to the appended drawings are now explained. While numerous details are set forth, it is understood that some embodiments of the invention may be practiced without these details. In other instances, well-known circuits, structures, and techniques have not been shown in detail so as not to obscure the understanding of this description.

Figure 1:
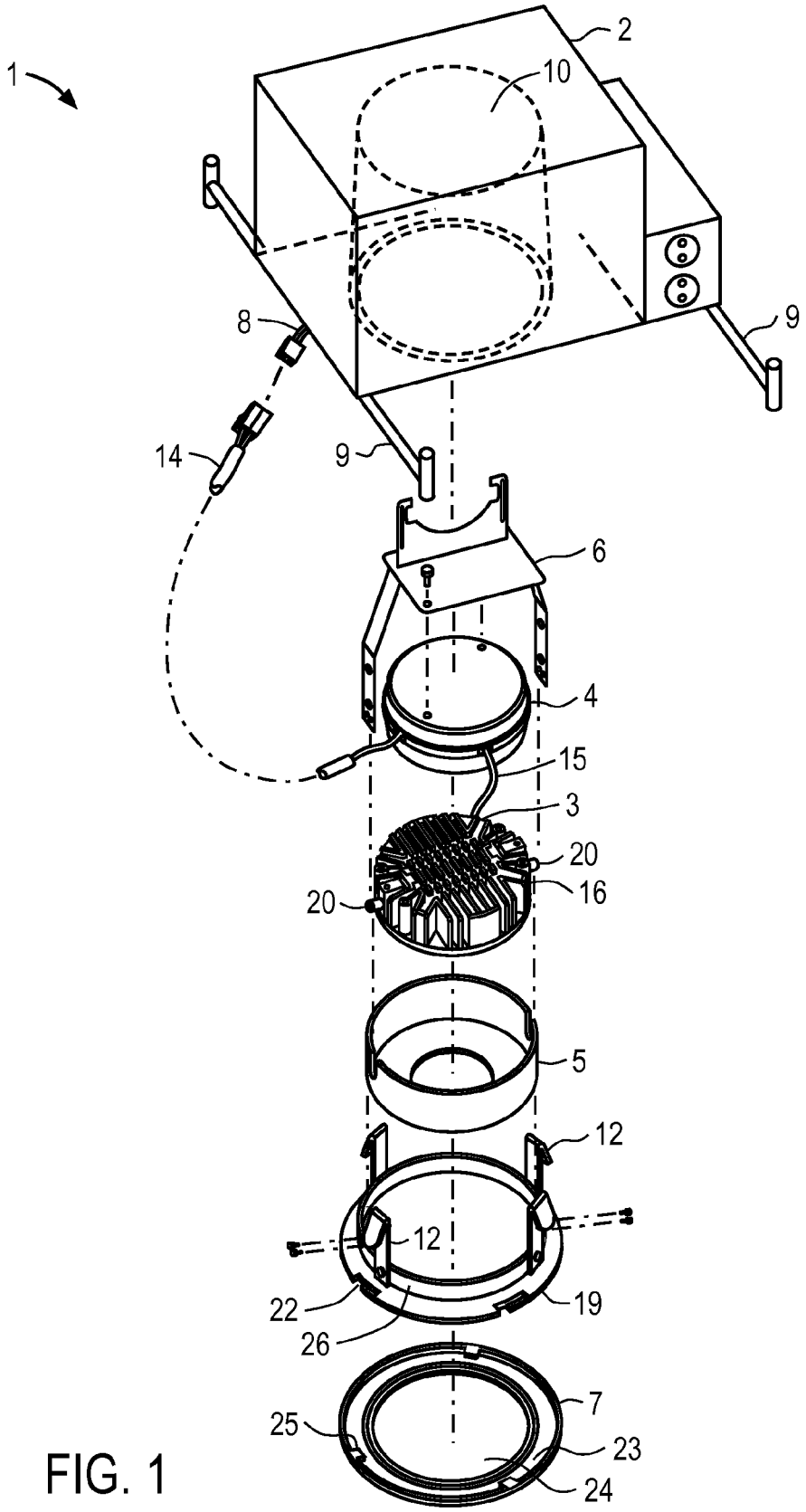
FIG. 1 shows an exploded view of a pivoting recessed lighting system.

FIG. 1 shows an exploded view of a pivoting recessed lighting system 1. The recessed lighting system 1 may include a housing 2, a light module 3, a driver (e.g., a power supply) 4, a chassis 6, and a trim 7. Although shown with a single housing 2 and trim 7, the light module 3, the driver 4, and the chassis 6 may be similarly used with different sized housings 2 and trims 7. Each of the elements of the pivoting recessed lighting system 1 will be explained by way of example below.

The housing 2 is a structure that separates the inner components of the pivoting recessed lighting system 1 from the items inside a ceiling or crawl space (e.g., insulation) in which the housing 2 has been installed. The support braces 9 may be used to affix the housing 2 to a stud, beam, or other structural member inside the ceiling or crawl space. In one embodiment, the housing 2 acts as a heat barrier to block heat emitted by the light module 3 and the driver 4 from reaching possibly flammable items inside a ceiling or crawl space. The housing 2 may have a can (not shown) and electrical wires 8 used to bring electrical AC power (e.g., 120 VAC, 240 VAC) to the driver 4, in accordance with well-known or conventional techniques. The housing 2 may be formed of metals, polymers, metal alloys, and/or other heat insulating materials.

Figure 2:
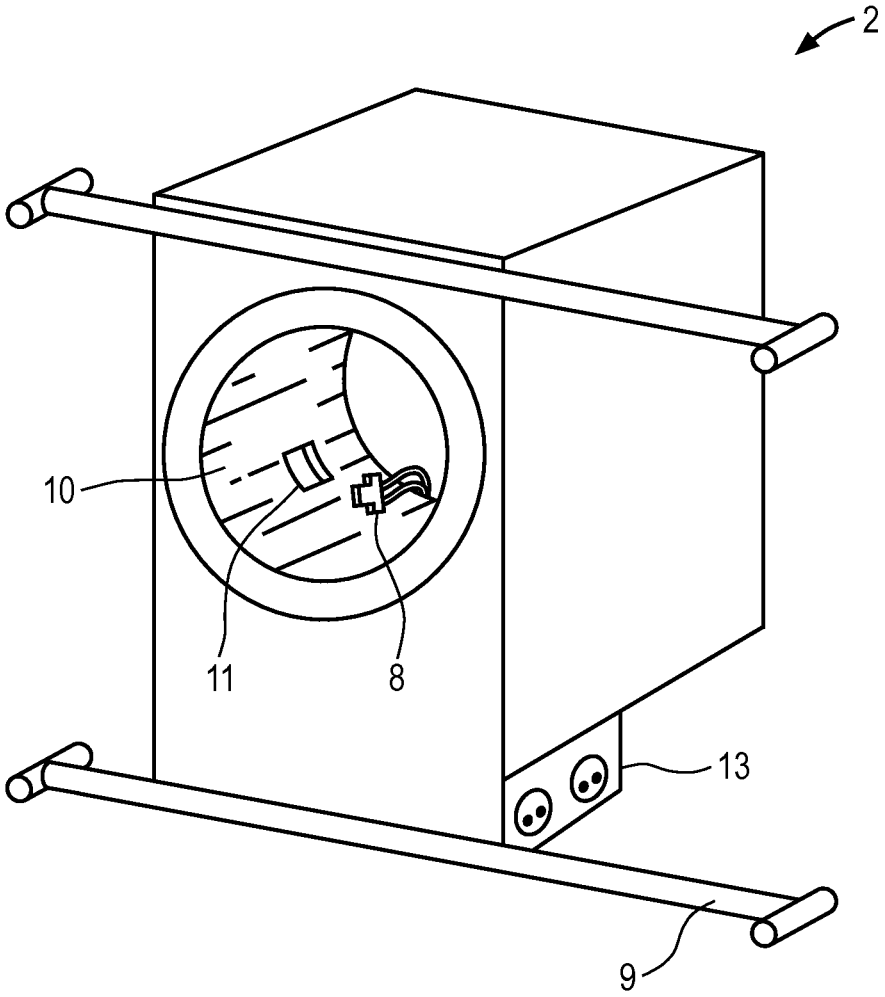
FIG. 2 shows a housing of the pivoting recessed lighting system.

As shown in FIG. 1, the housing 2 may be a polygon that defines a cavity 10 therein. However, the housing 2 may be any suitable shape, including an ellipsoid, cone, or cylinder. The cavity 10 is to receive therein the light module 3, the driver 4, and the chassis 6. As shown in FIG. 2, the housing 2 includes retention brackets 11 on the walls of the cavity 10 for receiving or engaging with complementary support brackets 12 that are attached to a part of a light producing assembly. The retention brackets 11 may be any device/component for receiving support brackets 12 to firmly hold the weight of a combined trim 7, light module 3, driver 4, chassis 6, and other components that make up a light producing assembly up against the housing 2. For example, the retention brackets 11 may be slots formed in a sidewall that defines the cavity 10 or they may be the hard, flat sidewall itself against which the support brackets 12 are held by friction.

The cavity 10 that is formed in the housing 2 may be larger in diameter (or in the transverse direction) than the light module 3 and the driver 4 such that the light module 3 and the driver 4 can easily fit into the cavity 10 without coming into direct contact with the walls of the cavity 10. In one embodiment, the cavity 10 is sized such that the light module 3 may pivot thirty degrees or more about a transverse axis of the housing, relative to the longitudinal axis such that light emitted by the light module 3 may be focused on various areas of a room. In some embodiments, the diameter of the cavity 10 is substantially larger than the diameter of the light module 3 and the driver 4. The size of the cavity 10 may be pursuant to popular industry specifications for recessed lighting systems. For example, the cavity 10 may be about four inches in diameter in compliance with Underwriters Laboratories (UL) 1598 or consistent with a "4-inch recessed lighting system."

The cavity 10 is open on a bottom end to allow light from the light module 3 coupled therein to illuminate an outside environment (e.g., a room). The bottom end of the cavity 10, which is open, may be surrounded by a thin ring, made of rubber or another suitable material, to allow for a better seal with the trim 7.

The electrical wires 8 of the housing 2 provide electricity to the driver 4. The electrical wires 8 may include two or more hot lines that deliver electricity and one or more lines that ground the light module 3 and the driver 4. In one embodiment, a main line from a circuit breaker (not shown) is run directly to a junction box 13 on the housing 2 (see FIG. 2). The electrical wires 8 connect to the main line via the junction box 13. The junction box 13 may regulate current through an embedded circuit to supply a stable voltage within the operating parameters of the driver 4; alternatively the junction box 13 may be simply an electrical splitter. The electrical wires 8 may include a plug connector that allows for easy connection with a complimentary connector of the driver 4. For example, the plug connector may be a keyed connector or interlocking connector. In one embodiment, the wires 8 terminate in an Edison Base socket style or a GU-24 style connector for interlocking with a complementary connector of the driver 4. Interoperability with Edison Base and GU-24 style connectors allows flexibility in retrofitting the light module 3 and the driver 4 in an existing/used housing 2.

The driver 4 is an electronic device that supplies or regulates electrical energy to the light module 3, and thus powers the light module 3 to emit light. The driver 4 may by any type of power supply, including power supplies that deliver an alternating current (AC) or a direct current (DC) voltage to the light module 3. In one embodiment, the driver 4 receives electricity from the housing 2 via the electrical wires 14. In this embodiment, the electrical wires 14 of the driver 4 are connected to the electrical wires 8 of the housing 2. In one embodiment, the electrical wires 14 of the driver 4 include a plug connector that allows for easy connection with a complimentary connector of the electrical wires 8 of the housing 2. For example, the plug connector may be a keyed connector or interlocking connector.

Upon receiving electricity, the driver 4 may regulate current or voltage through an embedded circuit to supply a stable voltage or current within the operating parameters of the light module 3. The driver 4 may transfer electricity to the light module 3 through an electrical connector. For example, the driver 4 may deliver electricity to the light module 3 through an electrical cable 15. The electrical cable 15 may be coupled between the light module 3 and the driver 4 through removable or permanent connectors. The electrical cable 15 may be sufficient in length to allow the light module 3 to freely pivot while the driver 4 remains static. For example, the electrical cable 15 may be between 1-2 inches in length.

The light module 3 may be any electro-optical device or combination of devices for emitting light. For example, the light module 3 may have as a single light source a light emitting diode (LED), organic light-emitting diode (OLED), or polymer light-emitting diode (PLED). The light module 3 receives electricity from the driver 4 as described above such that the light module 3 may emit a controlled beam of light into a room. The driver 4 is designed to ensure that the approximate voltage and current are fed to the light module 3 (through the cable 15) to enable the emission of light by the light source in the light module 3.

In one embodiment, a cover 5 may be attached to the light module 3 for protecting the light module 3 and adjusting light emitted by the light module 3. In one embodiment, the cover 5 may include an integrated lens, filter, and/or a reflector for focusing, multiplying, or adjusting light emitted by the light module 3. For example, multipliers may be used, which control the omni-directional light from "A" style bulbs. In comparison, other optical elements may be used to provide a diffused light. In one embodiment, the cover 5 also provides a protective barrier for the light module 3 and shields the light module 3 from moisture or inclement weather. In one embodiment, the cover 5 and the light module 3 are contained in a single indivisible unit. In another embodiment, the cover 5 may be attached to the light module 3 through the use of adhesive, fasteners, bolts, or any similar connectors.

In one embodiment, the cover 5 includes grooves which allow the passage of prongs 20, which will be described in further detail below, from the light module 3 to the chassis 6. The grooves may be rounded and larger than the prongs 20 to allow the prongs 20 to rotate without interference from the cover 5.

In one embodiment, the light module 3 includes one or more heat sinks 16 to cool the light module 3. Although the heat sinks 16 are shown as passive components that cool the light module 3 by dissipating heat into the surrounding air, active heat sinks (e.g., fans) may also be used. In one embodiment, the heat sinks 16 are defined by a set of fins surrounding an outside casing of the light module 3. The heat sinks 16 may be composed of any thermally conductive material. For example, the heat sinks 16 may be made of aluminium alloys, copper, copper-tungsten pseudoalloy, AlSiC (silicon carbide in aluminium matrix), Dymalloy (diamond in copper-silver alloy matrix), and E-Material (beryllium oxide in beryllium matrix).

Figure 3:
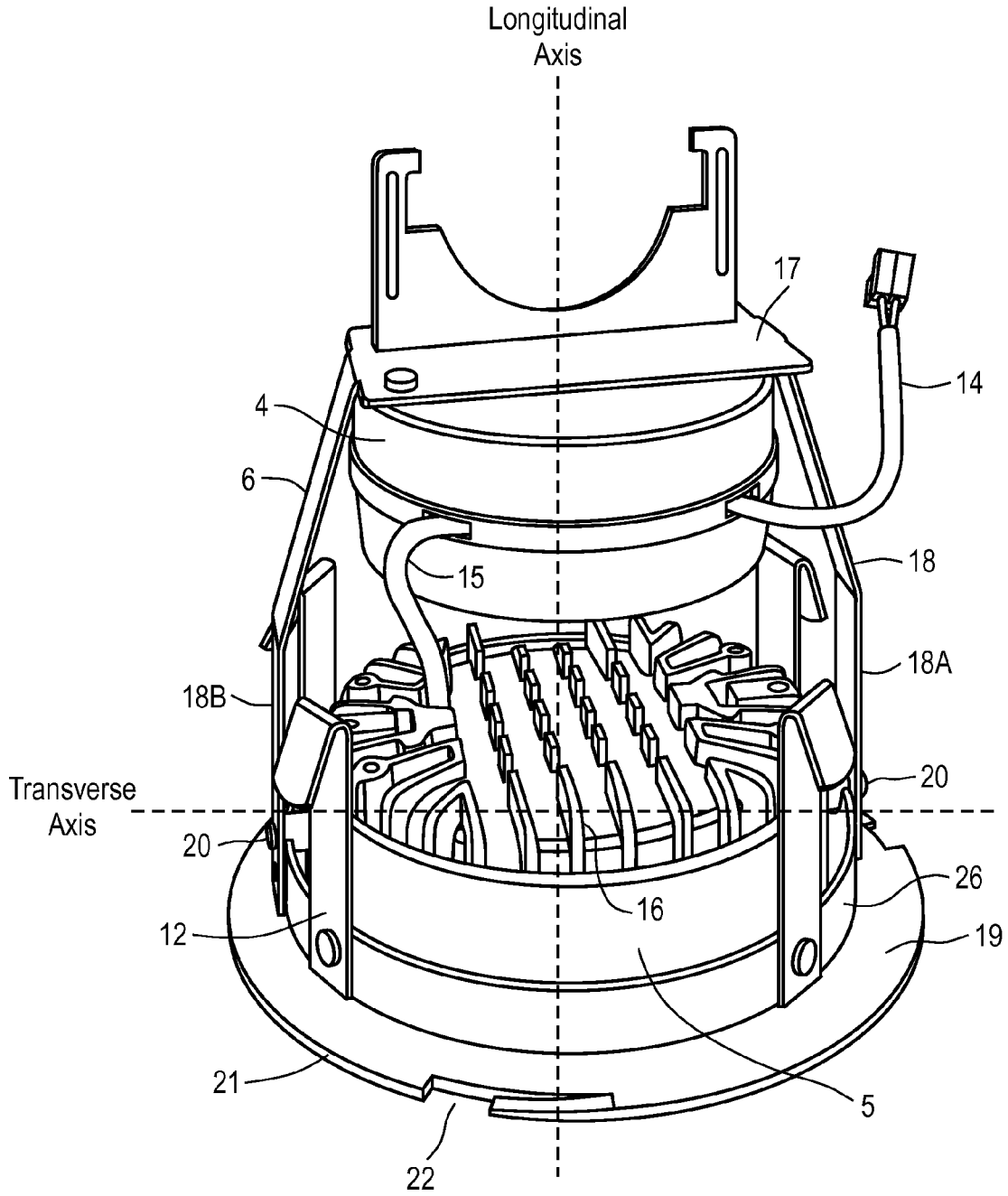
FIG. 3 shows an example light module, driver, and outer lip coupled to a chassis of the recessed lighting system.

FIG. 3 shows one embodiment of the light module 3 and the driver 4 coupled to the chassis 6. The chassis 6 may include a driver mount 17 and a light module mount 18. The driver mount 17 is a surface or other structure for receiving and holding the driver 4 in a static position. As shown in FIG. 3, the driver mount 17 is a flat structure that may be coupled to the driver 4 through the use of screws. In other embodiments, the driver 4 may be coupled to the driver mount 17 through the use of other connecting devices, including adhesives, clips, bolts, or clamps.

Figure 4A:
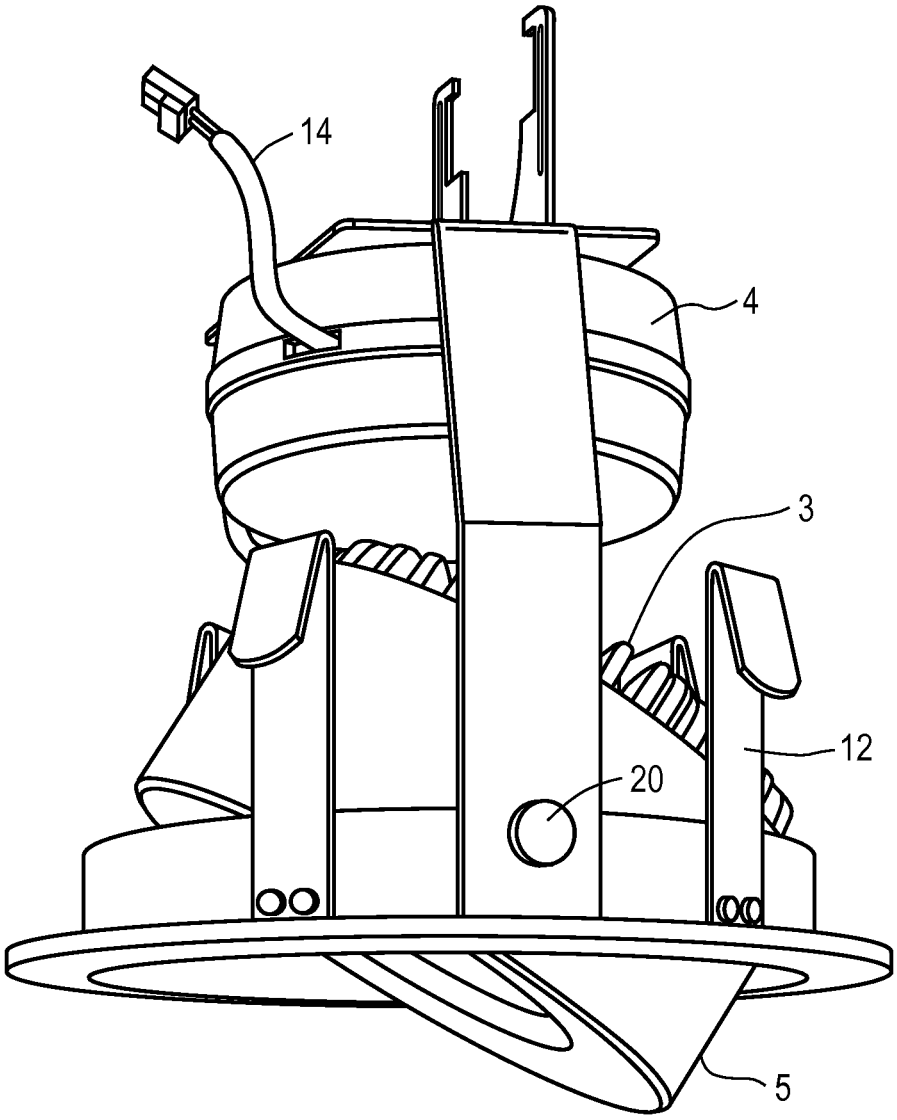
FIG. 4A shows the light module in a position pivoting relative to the driver and the chassis.
Figure 4B:
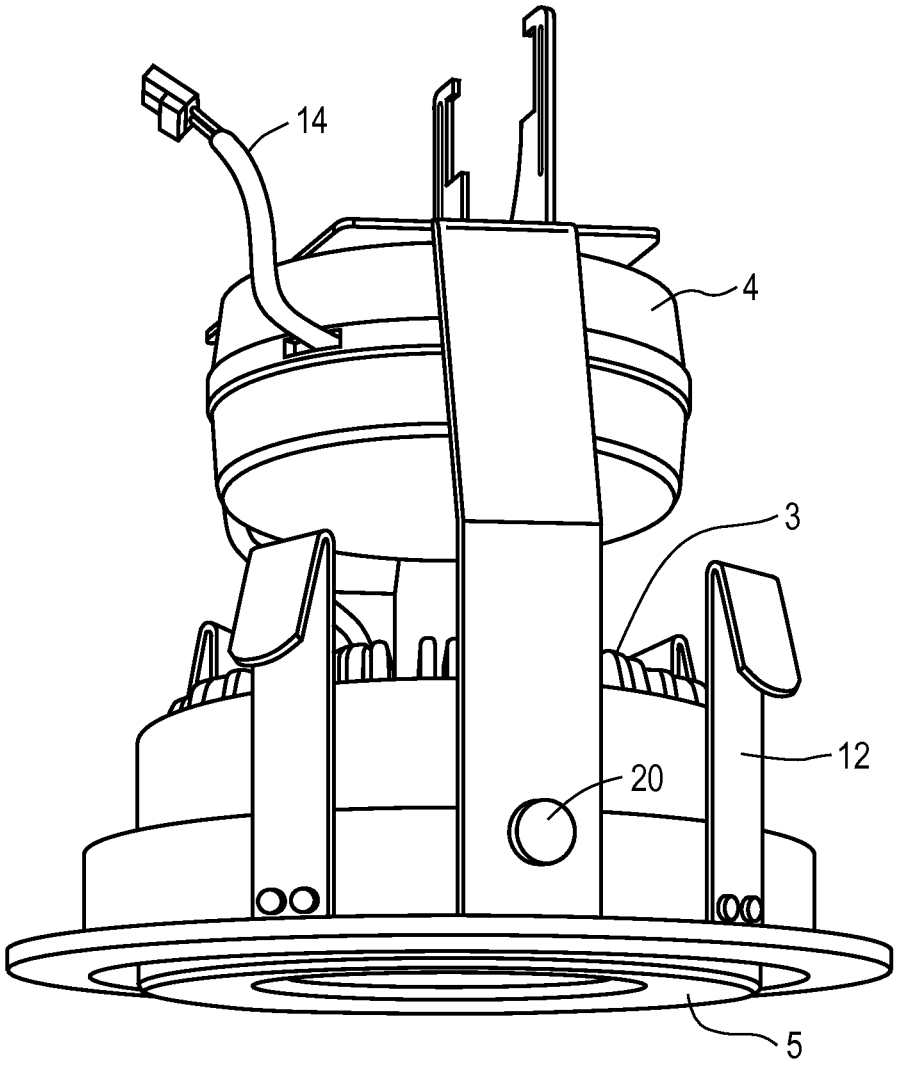
FIG. 4B shows the light module in a position directly downward.

In one embodiment, the light module mount 18 is a set of surfaces or other structures for receiving and pivotally holding the light module 3 such that the light module 3 may pivot/rotate about a transverse axis as shown. In one embodiment shown in FIG. 3, the light module mount 18 is defined by a set of legs 18A and 18B extending below and on opposite sides of the driver mount 17. In this embodiment, the light module 3 may include a set of rotatable prongs 20 for coupling the light module 3 to the light module mount 18 at a lower end of the legs 18A and 18B as shown. The light module 3 may be coupled to the rotatable prongs 20 through the use of any connecting mechanism, including resins, clips, screws, bolts, or clamps. The rotatable prongs 20 act as rotation points along the transverse axis to allow the light module 3 to pivot, relative to the chassis 6 and the legs 18A and 18B such that the light module 3 may focus light to different areas of a room. For example, the light module 3 may pivot and may be fixed up to thirty degrees relative to the longitudinal axis in either direction (as shown in FIG. 4A). FIG. 4B shows the module 3 configured to be aligned with or pointing along the longitudinal axis. The light module 3 may be pivoted by a user through the application of force to a surface of the light module 3 or a surface of the cover 5, which is coupled to the light module 3. In one embodiment, the rotatable prongs 20 may be tensioned to allow the placement of the light module 3 at a specific non-zero angle without the continued application of force by a user.

Although shown as including two rotatable prongs 20 for rotating the light module 3, in other embodiments the light module 3 may have any number of rotatable prongs 20 for allowing the pivoting movement of the light module 3. For example, the light module 3 may include a single rotatable prong 20 for allowing rotation of the light module 3 about the transverse axis. In other embodiments, different mechanisms are used to allow the rotation of the light module 3 along multiple axes. For example, one or more of a gimbal, a Cardan suspension, a heligimbal, or a universal joint may be used to allow the light module 3 to pivot/rotate along multiple transverse axes. Such mechanisms may be integrated into the light module 3 or affixed between the light module 3 and the chassis 6.

Even while the light module 3 is being pivoted or remains in a downward pointing configuration (aligned with the longitudinal axis), the driver 4 remains static relative to the light module 3. By being mechanically separate from the pivoting light module 3, the driver 4 does not interfere with the movement of the light module 3. In particular, since the light module 3 is not directly coupled to and is mechanically separate from the driver 3, a shorter structure is being pivoted (i.e., the light module 3) which as a result does not require additional space in the cavity 10 to accommodate the rotation of the driver 4. This independent freedom of movement allows the light module 3 to achieve a greater degree of rotation in comparison to light modules 3 that are mechanically dependent to the drivers 4. This freedom of movement further allows the use of smaller light modules 3, drivers 4, and chassis 6, which can be retrofitted into small housings 2 and cavities 10 while still maintaining a large degree of rotation.

As seen in FIG. 1 and FIGS. 4A and 4B, in one embodiment, the pivoting recessed lighting system 1 may include multiple support brackets 12 for coupling the chassis 6 and consequently the light module 3, the driver 4, and the trim 7 to the housing 2. The support brackets 12 may be v-springs, tension springs, or friction clips. The support brackets 12 are individually bendable allowing the support brackets 12 to be bent and inserted into the cavity 10 of the housing 2. Upon being inserted into the cavity 10 and released, the support brackets 12 engage the complementary retention brackets 11 that are attached to the walls of the cavity 10 (see FIG. 2). The retention brackets 11 may be any device/component for receiving the support brackets 12 and firmly coupling the combined chassis 6, light module 3, driver 4, and trim 7 to the housing 2. For example, the retention brackets 11 may be slots formed in a sidewall that defines the cavity 10 or the hard, flat sidewall itself.

In one embodiment, the support brackets 12 may be coupled to and extend upwards from an outer lip 19 (see FIGS. 1 and 3). As described below, the outer lip 19 is coupled to the chassis 6 and is used for connecting/anchoring the trim 7 to the chassis 6. In another embodiment, the support brackets 12 are located on the trim 7. By locating the support brackets 12 on the trim 7 instead of on the outer lip 19, only the relatively inexpensive trim 7 needs to be changed or replaced to be compatible with the retention brackets 11 of various housings 2. This allows a single chassis 6, light module 3, outer lip 19, and/or driver 4 to be used with a variety of different housings 2, with the simple change of the trim 7.

As noted above, an outer lip 19 may be coupled to the chassis 6 for use with coupling the trim 7 to the chassis 6. The outer lip 19 includes a ridge 26 and a locking surface 21 that surrounds and is perpendicular to the ridge 26. In one embodiment, the support brackets 12 may be coupled to and extend upwards from an outer lip 19 (see FIGS. 1 and 3). The ridge 26 may include one or more grooves, which allow the passage of the prongs 20 from the light module 3 to the chassis 6. The grooves may be rounded and larger than the prongs 20 to allow the prongs 20 to rotate without interference. In one embodiment, the prongs 20 are coupled directly to the ridge 26, such that the light module 3 may pivot along a transverse axis while the driver 4 remains static. In this embodiment, the prongs 20 may be coupled to the ridge 26 through the use of adhesives, clips, bolts, or clamps. Although shown as being part of the light module 3, in one embodiment the prongs 20 may be part of the ridge 26 such that the prongs 20 may be inserted into complimentary receiving holes of the light module 3.

The locking surface 21 may be rounded at the outer peripheries as shown, and may include one or more slots 22 formed along the outer periphery of the surface 21, for receiving and engaging complimentary elements of a trim 7. The slots 22 may be beveled to provide an easier connection with the trim 7 that creates a firmer friction fit and prevents deformation of the slots 22 and complimentary elements of the trims 7 during engagement and disengagement. The slots 22 may be uniformly distributed around the locking surface 21. For example, there may be three slots 22 located at 0°, 120°, 180°, and 240° around the locking surface 21. However, in other embodiments the slots 22 may be non-uniformly distributed to, for example, to account for weight distribution inconsistencies of the light module 3, the driver 4, and/or the chassis 6. In other embodiments, the slots 22 may be replaced with other devices for coupling the outer lip 19 to the trim 7. For example, the outer lip 19 may include a threaded structure for engaging a complimentary threaded structure of the trim 7 or a set of clamps for coupling with the trim 7. In another example, magnets (e.g., earth magnets) may be coupled to the outer lip 19 and/or the trim 7 to couple the trim 7 to the outer lip 19.

The trim 7 serves a primary purpose of covering the exposed edge of the ceiling or wall where a hole is formed in which the pivoting recessed lighting system 1 resides. In doing so, the trim 7 helps the recessed lighting system 1 appear seamlessly integrated into the ceiling or wall. In one embodiment, different diameter trims 7 may be capable of being coupled to a single sized chassis 6 and locking surface 21. The size and design of the trim 7 may depend on the size of the hole in which the housing 2 has been fitted and that it must conceal as well as the aesthetic decisions of the consumer. The trims 7 may be made of aluminum plastic polymers, alloys, copper, copper-tungsten pseudoalloy, AlSiC (silicon carbide in aluminum matrix), Dymalloy (diamond in copper-silver alloy matrix), and E-Material (beryllium oxide in beryllium matrix).

The trim 7 may include a flat border surface 23 that surrounds an aperture 24 and is surrounded by several tabs 25. In one embodiment, the spacing between the tabs 25 on the trim 7 is identical to the spacing between the slots 22 on the outer lip 19. For example, if slots 22 are located at 0°, 120°, and 240° around the locking surface 21, the tabs 25 are located at 0°, 120°, and 240° around the border surface 23 of the trim 7. The tabs 25 are sized to fit within or pass through the associated slots 22 when the trim 7 and the outer lip 19 are aligned, such that the outer lip 19 and the trim 7 can be twistably coupled together. The tabs 25 may be passed through the slots 22 and moved to contact the top surface of the outer lip 19 thereby creating a coupling, friction connection. In one embodiment, the tabs 25 may be beveled to form an isosceles trapezoid or similar type of shape. The beveled shape of the tabs 25 provides an easier connection with the outer lip 19 that prevents deformation of the tabs 25 and the complimentary sections of the outer lip 19. As described, the outer lip 19 and the trim 7 are directly coupled together through a simple twisting motion of the trim 7 relative to the outer lip 19 without the assistance of tools.

Figure 5:
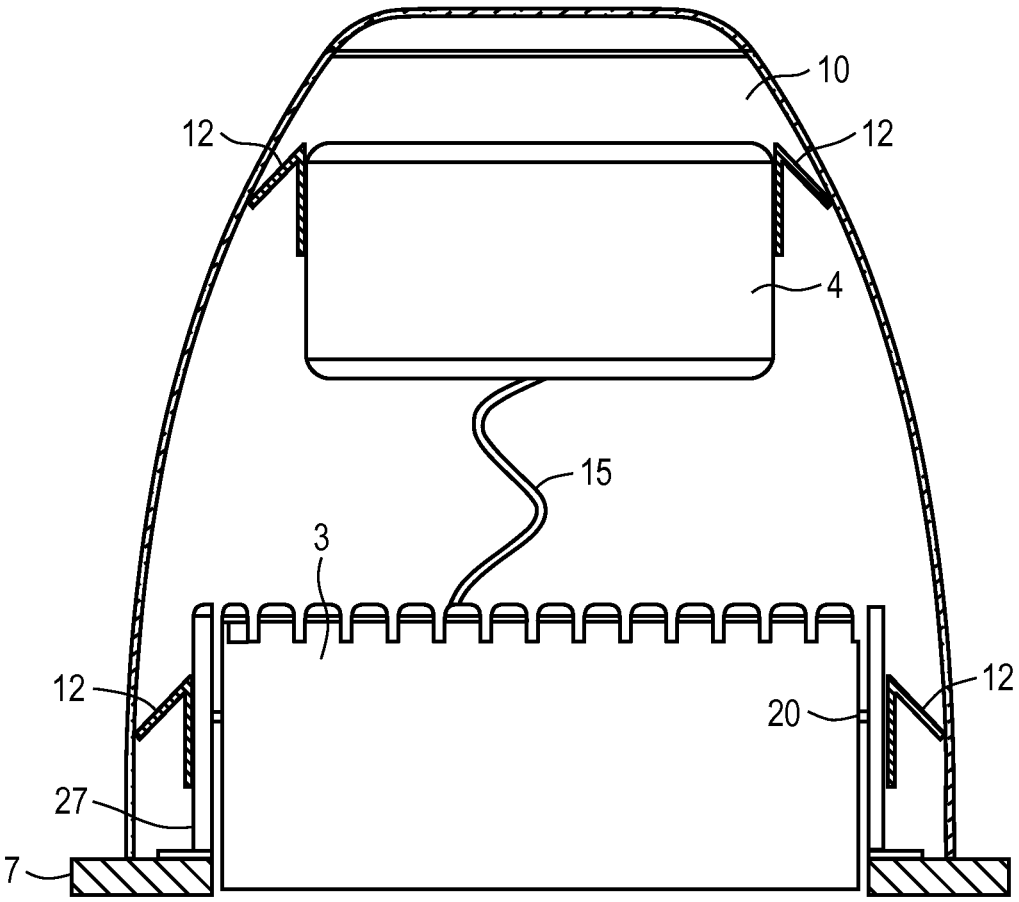
FIG. 5 shows the pivoting recessed lighting system without a chassis.

Although described as including the chassis 6, in some embodiments the light module 3 and the driver 4 may be directly coupled inside the cavity 10 of the housing 2 without the chassis 6. For example, as shown in FIG. 5, the driver 4 may include one or more support brackets 12 for directly coupling the driver 4 to a sidewall of the cavity 10. The support brackets 12 may be any device for supporting the driver 4 inside the cavity 10, including v-springs, tension springs, or friction clips. The support brackets 12 may couple to a sidewall of the cavity 10 through the use of the retention brackets 11 (shown in FIG. 2). As noted above, the retention brackets 11 may be any device/component for receiving support brackets 12 to firmly hold the weight of the driver 4 up against the sidewall of the cavity 10. For example, the retention brackets 11 may be slots formed in a sidewall that defines the cavity 10 or they may be the hard, flat sidewall itself against which the support brackets 12 are held by friction.

In this embodiment described above, the light module 3 may also include one or more support brackets 12 for directly coupling the light module 3 to a sidewall of the cavity 10. As shown in FIG. 5, the light module 3 is coupled inside the cavity 10 at a sufficient distance to allow the light module 3 to rotate/pivot about an axis. Although the light module 3 and the driver 4 may maintain an electrical connection through the electrical cable 15, the light module 3 and the driver 4 are mechanically separate such that the light module 3 may pivot while the driver 4 remains static. In this embodiment, the light module 3 may include a single or multi-axis gimbal 27 with one or more prongs 20, which allows the light module 3 to pivot relative to one or more axes, but separate from the driver 4. Since the light module 3 is not directly coupled to and is mechanically separate from the driver 3, a shorter structure is being pivoted (i.e., the light module 3) which as a result does not require additional space in the cavity 10 to accommodate the rotation of the driver 4. This independent freedom of movement allows the light module 3 to achieve a greater degree of rotation in comparison to light modules 3 that are mechanically dependent to the drivers 4. This freedom of movement further allows the use of smaller light modules 3 and drivers 4, which can be retrofitted into small housings 2 and cavities 10 while still maintaining a large degree of rotation.

In one embodiment, the light module 3 is coupled to the outer lip 19 and the outer lip 19 is coupled to the cavity 10 through the use of the support brackets 12. In this embodiment, the outer lip 19 acts as the gimbal 27 to allow the light module 3 to rotate/pivot and the trim 7 may directly couple to the outer lip 19.

Figure 6:
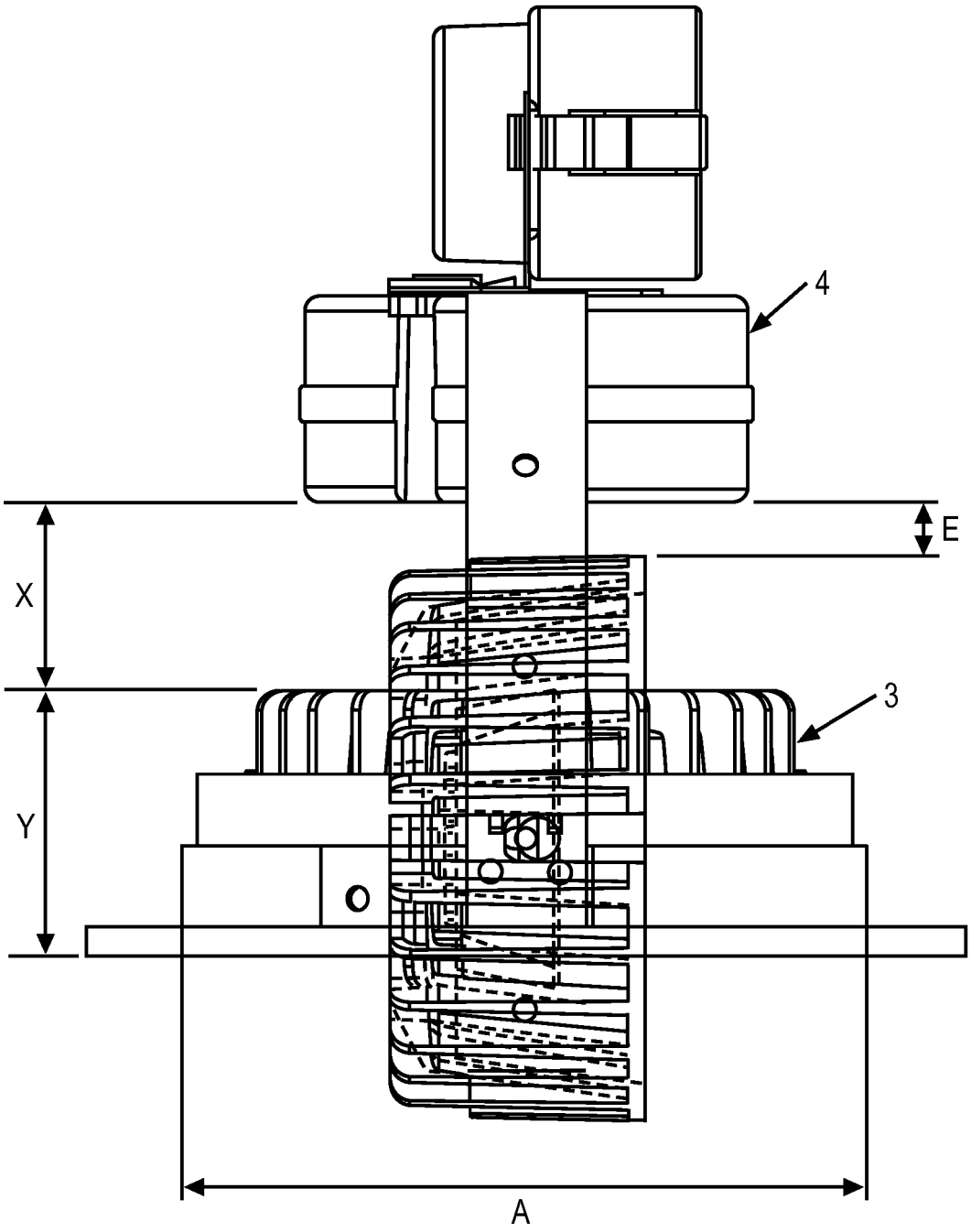
FIG. 6 shows the light module in pointing along the longitudinal axis and rotated

FIG. 6 shows the light module 3 pointing along the longitudinal axis and also rotated. As described above and shown in FIG. 6, while the light module 3 is aligned with or pointing along the longitudinal axis, the light module 3 and the driver 4 may be separated by a distance X sufficient to allow the light module 3 to pivot without contacting the driver 4. After being pivoted, the light module 3 may be separated from the driver 4 by the distance E, where E is between 1/16-2 inches. In one embodiment, the distance X is defined as $A/2-Y \leq X$, where A is the diameter of the light module 3 and Y is the height of the light module 3. For example, when the light module 3 is designed to pivot a maximum of forty-five degrees, the distance X may be 2 inches and the distance E may be 0.5 inches for a light module 3 with a diameter A of 4 inches and a height Y of 2 inches. In another example, when the light module 3 is designed to pivot a maximum of 10 degrees, the distance X may be 1 inch and the distance E may be 0.25 inches for a light module 3 with a diameter A of 4 inches and a height Y of 2 inches.

While certain embodiments have been described and shown in the accompanying drawings, it is to be understood that such embodiments are merely illustrative of and not restrictive on the broad invention, and that the invention is not limited to the specific constructions and arrangements shown and described, since various other modifications may occur to those of ordinary skill in the art. The description is thus to be regarded as illustrative instead of limiting.

What is claimed is:

1. A pivoting recessed lighting system, comprising:

a light module for emitting light;

a driver for powering the light module to emit light;

a chassis for mounting the light module and the driver, wherein (1) the light module is pivotably coupled to the chassis such that the light module may pivot about an axis and (2) the driver is coupled to the chassis to remain static and mechanically independent from the light module; and a plurality of rotatable prongs coupled between the light module and the chassis, the rotatable prongs allowing the light module to pivot relative to the chassis and the driver.

2. The pivoting recessed lighting system of claim 1, further comprising:

an outer lip coupled to the chassis, the outer lip including a plurality of slots separated by one or more ridges located on a locking surface of the outer lip.

3. The pivoting recessed lighting system of claim 2, further comprising:

a housing that defines a round cavity to receive the light module, the driver, and the chassis, wherein the housing is configured to be installed within a wall or ceiling of a building; and a trim coupled to the outer lip for covering a hole in which the lighting system is placed within.

4. The pivoting recessed lighting system of claim 3, wherein the trim comprises:

a plurality of tabs to fit through the plurality of slots and for coupling the trim to the outer lip by engaging the ridges of the outer lip through a twist and lock motion.

5. The pivoting recessed lighting system of claim 3, wherein the chassis comprises:

a driver mount for statically mounting the driver to the chassis; and a light module mount for mounting the light module.

6. The pivoting recessed lighting system of claim 5, further comprising:

support brackets for coupling the combined chassis, light module, driver, and the trim to the housing.

7. The pivoting recessed lighting system of claim 6, wherein the support brackets are one of a V-spring and a friction clip.

8. The pivoting recessed lighting system of claim 6, wherein the support brackets are located on the outer lip.

9. The pivoting recessed lighting system of claim 6, wherein the support brackets are located on the trim.

10. The pivoting recessed lighting system of claim 1, wherein the light module is a light emitting diode (LED) module and the driver coverts an alternating current (AC) to a direct current (DC) for driving the LED module.

11. The pivoting recessed lighting system of claim 1, further comprising:

a cover to shield the light module while being transmissive to light emitted by the light module.

12. The pivoting recessed lighting system of claim 1, further comprising:

a plurality of fins on one or more sides of the light module for dissipating heat produced by the light module.

13. The pivoting recessed lighting system of claim 1, further comprising:

a cover to shield the light module while being transmissive to light emitted by the light module, wherein the cover is mechanically coupled to the light module such that the cover pivots along with the light module.

14. The pivoting recessed lighting system of claim 13, wherein the cover includes one or more of an integrated lens, a filter, and a reflector for focusing, multiplying, or adjusting light emitted by the light module.

15. A pivoting recessed lighting system, comprising:

a housing that defines a round cavity;

a light module for emitting light, the light module pivotably coupled to a sidewall of the cavity;

a driver for powering the light module to emit light, the driver coupled to the sidewall of the cavity above and mechanically separate from the light module such that the light module may pivot while the driver remains static; and an outer lip coupled to the light module, the outer lip includes one or more support brackets for coupling the light module to the sidewall of the cavity, wherein the outer lip acts as a gimbal to allow the light module to pivot relative to the housing and the driver.

16. The pivoting recessed lighting system of claim 15, wherein the outer lip further includes a plurality of slots separated by one or more ridges located on a locking surface of the outer lip to receive a trim.

17. A pivoting retrofit recessed lighting system, comprising:

a light chassis, including:

a light module mount for receiving and pivotably coupling with a light module;

a driver mount for receiving and statically coupling with a driver for the light module, wherein (1) the light module is pivotably coupled to the light module mount such that the light module may pivot about an axis and (2) the driver is coupled to the chassis to remain static and mechanically independent from the light module; and a plurality of rotatable prongs coupled between the light module and the chassis, the rotatable prongs allowing the light module to pivot along a transverse axis relative to the chassis and the driver.

18. The pivoting retrofit recessed lighting system of claim 17, further comprising:

an outer lip coupled to the chassis, the outer lip including a plurality of slots separated by one or more ridges located on a locking surface of the outer lip; and support brackets coupled to a ridge that is perpendicular to the locking surface, the support brackets for coupling the chassis to a housing.

19. The pivoting retrofit recessed lighting system of claim 18, further comprising:

a trim coupled to the outer lip for covering a hole in which the lighting system is placed within.

* * * * *